United States Patent [19]

Flynn

[11] 4,013,007

[45] Mar. 22, 1977

[54] SELF-INKING HAND STAMP

[76] Inventor: Harold M. Flynn, 5138 E. Taylor St., Phoenix, Ariz. 85008

[22] Filed: Sept. 17, 1975

[21] Appl. No.: 614,257

[52] U.S. Cl. ..... 101/333; 101/103

[51] Int. Cl.[2] ..... B41K 1/42

[58] Field of Search ..... 101/103–106, 101/108, 327, 333, 334

[56] References Cited

UNITED STATES PATENTS

| | | | |
|---|---|---|---|
| 454,499 | 6/1891 | Ryer | 101/334 |
| 1,149,849 | 8/1915 | Matthews | 101/406 |
| 1,724,074 | 8/1929 | Du Belle | 101/327 X |
| 2,884,858 | 5/1959 | Boekeloo et al. | 101/327 |
| 2,983,219 | 5/1961 | Weissman | 101/333 X |
| 3,018,720 | 1/1962 | Nichols | 101/333 X |
| 3,783,786 | 1/1974 | Ellison et al. | 101/333 |
| 3,837,461 | 9/1974 | Waibel | 101/287 X |

FOREIGN PATENTS OR APPLICATIONS

| | | | |
|---|---|---|---|
| 1,209,733 | 3/1960 | France | 101/108 |

*Primary Examiner*—Edgar S. Burr
*Assistant Examiner*—Paul T. Sewell
*Attorney, Agent, or Firm*—Warren F. B. Lindsley

[57] ABSTRACT

A self-inking hand stamp incorporating an improved inking arrangement permitting a shorter stroke and also providing a special removable ink pad assembly with associated convenience features.

4 Claims, 11 Drawing Figures

SELF-INKING HAND STAMP

BACKGROUND OF THE INVENTION

In a modern supermarket or drugstore, the individual items packaged in cans, cartons or other containers are hand stamped to show the selling price. Because hundreds or thousands of such items must be marked, the operation becomes a tedious daily routine for the people who stock the shelves, and the speed and efficiency with which it can be accomplished is an important economic consideration. For these reasons, even the slightest improvement in the device is worthwhile if it contributes to the speed of the operation or to the reduction of operator fatigue.

DESCRIPTION OF THE PRIOR ART

A highly efficient self-inking hand stamping device is described by Lynn and Charles Ellison in U.S. Pat. No. 3,783,786. The Ellison device provides an indexing printing unit carried in an actuating frame which is forced downward for the printing operation by hand pressure applied to a vertical handle against a restraining spring. As the pressure is subsequently released, the spring returns the printing unit to an upward position and a lever arrangement causes the inking pad to swing under the still vertically aligned printing unit to ink the indexed letters for the next stamping operation.

While the Ellison device represents a significant improvement over earlier stamping devices, there are still areas for improvement especially in regard to the inking arrangement and in terms of the length of the operating stroke, a shorter stroke being desirable to achieve faster operation.

SUMMARY OF THE INVENTION

Therefore, in accordance with the invention claimed, an improved self-inking hand stamp is provided for price marking of retail sales items, such as grocery or drugstore products, the improved stamp permitting a more rapid and less tiring stamping operation along with a removable ink pad holder.

It is, therefore, one object of this invention to provide an improved self-inking hand stamp device for price marking retail items.

Another object of this invention is to provide in such a device an improved self-inking arrangement.

A further object of this invention is to provide such a device in which the improved self-inking arrangement makes possible a shorter operating stroke, thereby measurably reducing the operating time of the device and reducing the fatique experienced by the operator.

A still further object of this invention is to provide such a stamping device in which the inking is accomplished with the inking pad in an inclined rather than in a horizontal position, the printing unit tilting to a correspondingly inclined position at the top of the operating stroke, this method of inking accounting for the reduced stroke and operating time.

A still further object of this invention is to provide in such a device an inking action which causes less ink to be picked up by the printing unit, thereby producing clearer, more legible printed figures without smearing or blotting.

A still further object of this invention is to provide such a device in which the special inking arrangement permits the inking operation to be accomplished with the device slightly tilted relative to the surface to be marked, the slight tilt causing a reduction in operator fatique.

A still further object of this invention is to provide in such a device an improved inking pad and holder which is easily removed from the device for storage or replacement, thus facilitating a change to another type of ink or preventing the pad from drying and sticking fast to the printing unit while the device is not in use and discouraging theft of the device when the inking holder has been removed.

A still further object of this invention is to provide in such a device an improved inking pad holder which has a greater ink capacity.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
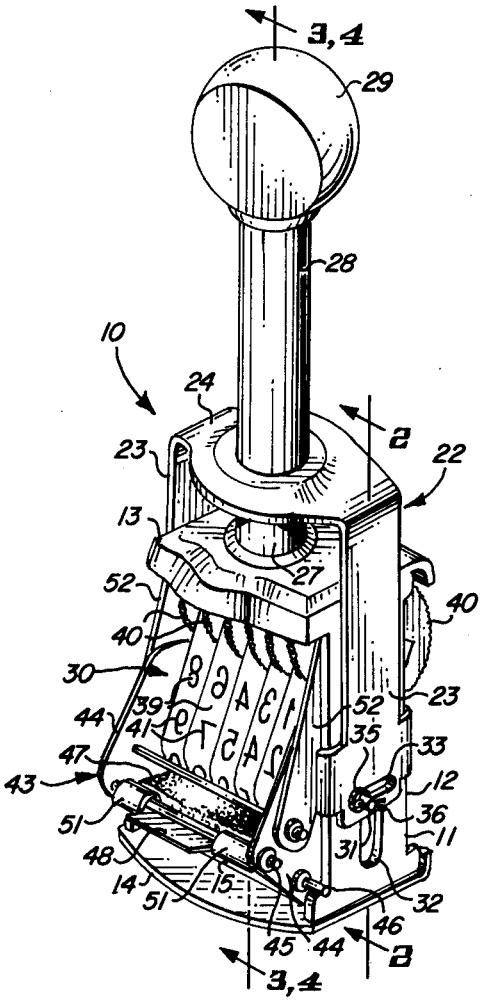
FIG. 1 is a perspective view of the self-inking hand stamp device of the invention employing the improved self-inking action but utilizing the prior art inking pad holder.
Figure 2:
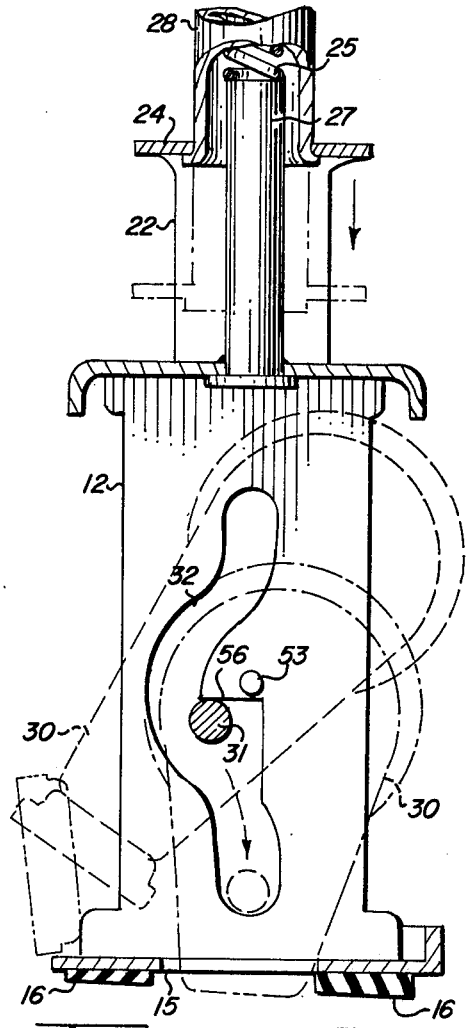
FIG. 2 is a cross-sectional side view of the device of FIG. 1 as viewed along line 2—2 of FIG. 1.
Figure 3:
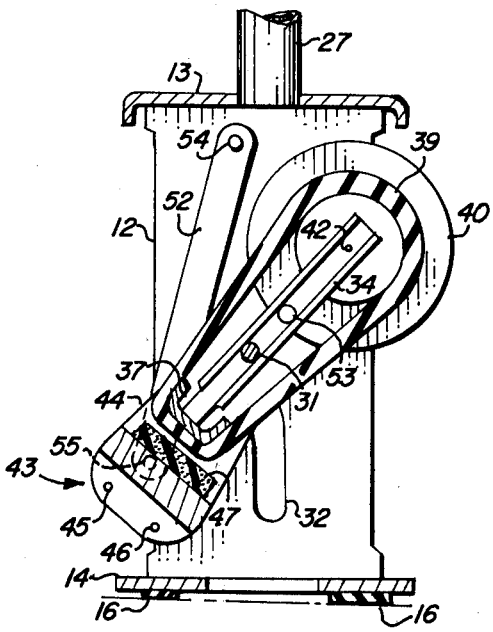
FIG. 3 is a cross-sectional side view of the device of FIG. 1 as viewed along the line 3—3 of FIG. 1 with the operating cycle stopped in the inking position.
Figure 4:
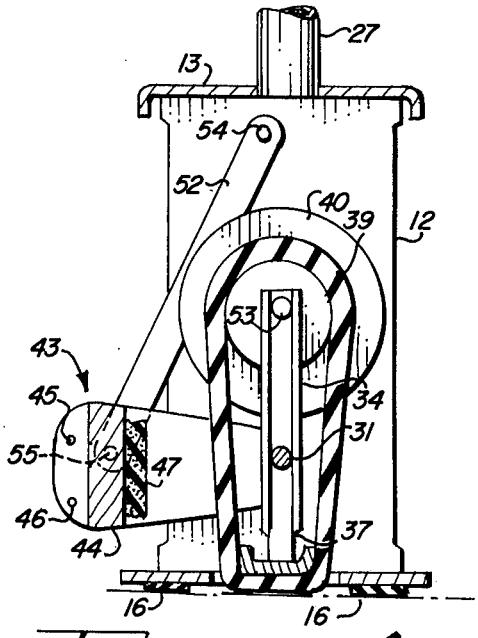
FIG. 4 is a cross-sectional side view of the device of FIG. 1 as viewed along line 4—4 of FIG. 1 with the operating cycle stopped in the printing position.
Figure 5:
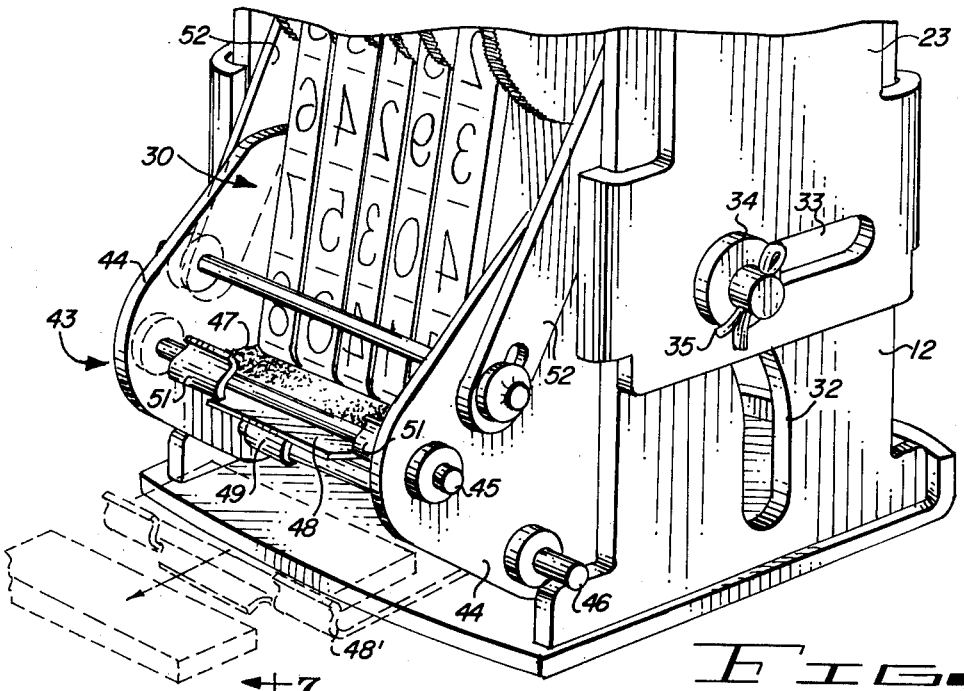
FIG. 5 is an enlarged perspective view of a part of the device revealing details of the special inking arrangement.

Referring more particularly to the drawing by characters of reference, FIGS. 1–5 disclose an improved self-inking hand stamp device 10 comprising a main body frame 11 of generally inverted U-shaped structure having respective coextensive spaced leg vertical side bars 12 connected at the top by a horizontal head bar 13 and having their lower ends fixedly secured to a base plate 14 having therethrough a central clearance opening 15 between the legs, and carrying elastomeric cushioning pads 16 on its lower face. As shown in FIGS. 2, 3 and 4, the thickness of pads 16 on one side of base plate 14 are of greater thickness than the thickness of the pad on the other side to cause the imprinting of device 10 to occur at an acute angle to the longitudinal axis of the device.

Mounted on and vertically reciprocable relative to the body frame is a printing unit actuating frame 22 of inverted U-shaped having opposite coextensive arms 23 which are spaced apart slightly greater than the frame bars 12 so as to be freely reciprocably movable vertically therealong and are desirably of the same width, being connected integrally by a head bar or web 24. Means for normally biasing the frame 22 upwardly relative to the frame 11 comprise a coiled compression spring 25 thrusting at its lower end against an upwardly projecting stem 27 centrally fixed on the head bar 13 and projecting into a tubular spring housing 28 fixed centrally on and opening downwardly from the head bar 24. The housing 28 is provided at its upper end with a blind end shoulder against which the upper end of the spring 25 thrusts. In addition, the tubular housing 28 may serve as a handle for manipulating the hand stamp and be equipped for this purpose with a suitable head knob 29. If preferred, of course, the frame 22 may be employed as a handle with digital pressure applied to the head bar 24 in depressing the printing frame against bias of the spring 25.

Means are provided for guiding the arms 23 along the bars 12 and for supporting a printing unit 30 to be actuated reciprocably with the printing frame 22. For this purpose, a drive bar 31 extends through arcuate substantially vertical guide slots 32 in the side bars 12, horizontal guide slots 33 in bars 12, and clearance holes near the lower end of two guide tracks 34 attached to printing unit 30. The "elongated slots" and "cam slots" of the claims correspond to "horizontal guide slots" and "vertical guide slots 32," respectively. Bar 31 is connected against displacement by means of washers 35 and cotter pins 36.

The printing unit 30 is similar to customary units of this type and is substantially identical to the printing unit described for the prior art in the aforementioned U.S. Pat. No. 3,783,786 including rubber character carrying bands 39, in this instance five, mounted on and about a horizontal bar 37 at the lower end of the unit and about respective adjustment wheels 40 at the opposite end of the unit each provided with a knurled edge digitally engageable adjustment flange of a diameter to project sufficiently beyond printing characters 41. Printing characters 41 may be numbers, punctuation marks or letters in series on the outer faces of the bands to enable convenient belt adjusting rotation of the wheels without contacting the characters by the manipulating fingers. Coaxial individually rotatable mounting of the wheels 40 is effected on a shaft 42 secured fixedly to and between the upper end portions of the guide tracks 34.

Means are provided for not only efficient positive adjustment driving of the belts or bands 39 by the wheels 40, but also effective indexing and retention of the bands in adjusted positions thereof. To this end, the endless bands 39 are desirably molded from an elastomer such as neoprene of 40–45 durometer and mounted on the printing unit under slight tension. Elasticity of the respective bands is improved by providing fairly deep transverse grooves between the relatively stiffer areas of the bands providing the characters 41 which have flat face planes. The character areas are thus separated by relatively flexible elastic integral webs which are preferably molded longitudinally in a slight inside concave outside convex form. Between the webs, the back faces of the respective bands are provided with traction means desirably comprising transverse serration like resilient rib teeth which are dimensioned to mesh with and are complementary to similar transverse rigid rib teeth on the drum perimeters of the wheels 40. This effects a fairly positive drive relationship between the wheels and bands and eliminates any need for backing on the bands, enabling a smoother, freer, easier adjustment manipulation of the bands through the wheels 41.

For indexing, a cooperative relationship is provided between the printing unit frame bar 37 and the bands 39. As is customary, the bar 37 provides a rigid thrust backing for the character areas of the bands to enable applying printing impressions of the printing characters 41 aligned on the bar onto objects against which impressed by thrusting the printing end of the printing unit through the clearance opening 15 in the base 14.

The guide tracks 34 are integral with the bar 37 in a U-shaped unit, the tracks 34 forming the vertical sides and the bar 37 forming the horizontal base. The edges of the tracks 34 are bent outward at right angles to form channels running lengthwise of the tracks 34.

Self-inking means are provided automatically operative to apply ink to the printing characters aligned along the bar 37. According to the present invention, such means comprise an inking device 43 constructed and arranged to move automatically into inking position when the printing unit 30 is in retracted position within the body frame 11 and to move automatically into clearance relationship to the printing unit when the printing unit is actuated into printing position by depressing the printing frame 22 relative to the body frame 11. Further, the inking device 43 is constructed and arranged for greatly facilitating supplying it with ink. To this end, the inking device 43 comprises a pair of body side plates 44 of identical, coextensive construction in spaced parallel relation, desirably of generally triangular outline and rigidly connected together along their lower aligned edges by a pair of spaced parallel coextensive rods 45 and 46, one of which is fixedly secured adjacent one corner area and the other to the other corner area adjacent such edge of the plates 44.

In addition to serving as frame connectors for the side plates, the rods 45 and 46 provide means for supporting an ink pad 47. Such pad comprises a suitable panel of ink-carrying and applying material. Commonly an absorbent felt pad has been used for this purpose, but significantly improved results are obtained by means of a pad of suitable thickness of interconnected cellular resilient foam material such as foam latex, polyvinylchloride foam, or the like, having minutely dimensioned porosity so as to be possessed of large ink capacity but strong and fairly uniform and adequately dense but porous applicator surface. It has been found that such material provides a continuously uniform application of ink to the printing characters as long as there is any ink on and in the pad.

For supporting the ink pad 47 operatively, an ink pad tray 48 is provided, the tray carrying two wrap-around hinged flanges 49 at opposite ends of its inboard edge and two snap-latch flanges 51 at opposite ends of its outboard edge, the hinge flanges 49 capturing rotatably but non-removably the rod 46 and the snap-latch flanges 51 gripping the rod 45. The flange 51 may be disengaged from the rod 45 and the tray 48 tilted downward as shown by the ghost image 48′ of the tray 48 in FIG. 5, the downward position facilitating the inking or changing of the pad 47.

The mounting of the inking device 43 and of the printing unit 30 is such as to cause the printing unit 30 to be rotated counterclockwise to a substantially vertical position and to be moved downwardly for the printing operation and subsequently to rise and tilt clockwise toward the inking device 43 for the inking operation. The downward movement and counterclockwise rotation is effected by hand pressure forcing the frame 22 downward while the upward movement and clockwise rotation is effected by the return of the frame 22 upwardly as accomplished by the spring 25 when hand pressure applied to frame 22 is released. The vertical and tiled positions of the inking unit 30 are shown by the ghost images in FIG. 2 and by the cross-sectional views of FIGS. 3 and 4 with FIG. 3 showing the inking position and FIG. 4 showing the printing position.

As the printing unit 30 begins to move away from the inking device 43 toward the vertical printing position, the inking device 43 simultaneously rotates in a clockwise direction while moving to the left and away from the printing unit 30.

These cooperative actions of the printing unit 30 and the inking device 43 effect separation in a manner which prevents brushing, rubbing or sliding friction between the pad 47 and the characters 41, thereby preventing excess collection of ink by the characters 41 during separation.

The novel means by which the movements of the printing unit 30 and of the inking device 43 are effected include two rocker arms 52, the aforementioned guide slots 32 and 33, the drive bar 31, the guide tracks 34, and two guide pins 53.

The rocker arms 52 are pivotally attached at their upper ends by means of pivot pins 54 to the inside of vertical side bars 12, one arm 52 being attached to each of the two bars 12. The lower end of each of the arms 52 is pivotally attached to the outside of one of the side plates 44 by means of a pivot pin 55, the pin 55 located just above the rod 45.

The drive bar 31 passes rotatably through holes in the upper ends of plates 44 and also as stated earlier through guide slots 32 and 33.

The guide pins 53 are fixedly attached, one to each of the vertical side bars 12, each extending perpendicularly inwardly from a central point on the side bar 12 into the channel of the guide track 34.

It will now be recognized that the inclination of the guide tracks 34 and hence the inclination of the printing unit 30 is determined by the inclination of a line drawn through the drive pin 31 and the guide pin 53. Further, while the guide pins 53 are stationary, the drive pin 31 is free to move horizontally within the slot 33, and its horizontal position is determined and controlled by the curvature of the slots 32 in bars 12. Thus, as frame 22 is forced downward taking with it drive pin 31, pin 31 is moved toward the right by slot 32 until it is vertically aligned with pins 53 at the fully downward or printing position. As frame 22 is released and moves upward, pin 31 moves upward and leftward along slot 32 causing unit 30 to tilt clockwise toward inking device 43. It will also be recognized that as pin 31 moves upward carrying with it unit 30, the guide tracks 34 are guided in their upward and rotational movement by guide pins 53, the tracks 34 sliding over the pins 53 which are captured within the channelled outer surfaces of the tracks.

By virtue of the pivotal attachment of side plates 44 of inking device 43 to drive pin 31, the inking device 43 is rotated counterclockwise as pin 31 moves upward. The upward movement of pin 31 and hence that of frame 22 is limited by a horizontal shoulder 56 cut into the right hand edge of each of the slots 32, the pin 31 moving against shoulder 56 as shown in FIG. 2 just as the lower end of the printing unit 30 and the selected characters 41 come into contact and parallel alignment with the pad 47. At this time, the guide pins 53, the drive pin 31 and the pivot pins 55 are in approximately linear alignment along a line perpendicular to pad 47. The rocker arms 52 permit the required freedom of movement for the inking device as it is moved laterally and rotationally by drive pin 31.

While in the prior art, it was necessary for the printing unit to rise a sufficient distance to permit the inking device to move underneath it for the inking operation, the arrangement of FIGS. 1–5 accomplishes the inking operation in the lateral position through the tilting action. By virtue of this mode of operation, the desired shorter operating stroke is achieved in accordance with a major object of the invention.

Figure 6:
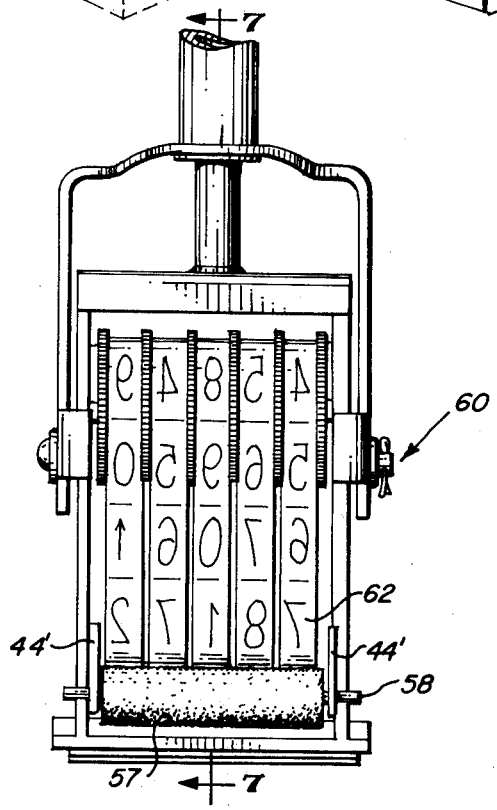
FIG. 6 is a side view of the improved self-inking hand stamp device of the invention in which a special inking roller is utilized.
Figure 7:
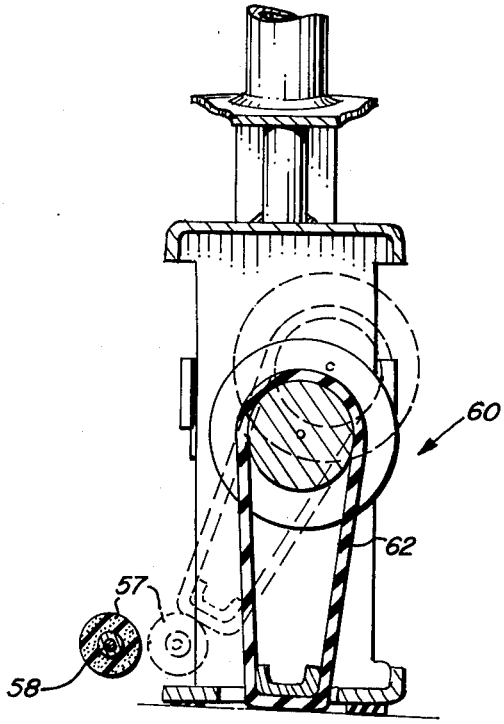
FIG. 7 is a cross-sectional side view of the device of FIG. 6 as viewed along line 7—7 of FIG. 6.

While the hand stamp device 10 of FIGS. 1–5 is shown and described in utilization with a conventional ink pad tray 48 which is similar or the same as that described in the prior art, FIGS. 6 and 7 illustrate a hand stamp device 60 having the same general printing and inking arrangement but adapted to employ an inking roller 57. The roller 57 of device 60 is mounted by means of its axle 58 which passes through holes in the two side plates 44, corresponding to plates 44 of device 10, the holes being located in a position lying midway between the positions occupied by rods 45 and 46 of device 10. In the arrangement of FIGS. 6 and 7, the roller 57 replaces the tray 48, the pad 47 and the rollers 45 and 46 but in all other respects, the hand stamp device of FIGS. 6 and 7 is the same as the device illustrated in FIGS. 1–5. Thus in operation, the printing unit 62 rises from the vertical printing position and tilts clockwise toward the roller 57 for the inking operation as shown in FIG. 7. Simultaneously, the roller 57 moves leftward for printing and toward the right for inking. As successive printing and inking operations occur, the roller 57 tends to rotate so that the total surface of the roller 57 is utilized for the application of ink to the printing characters.

Figure 8:
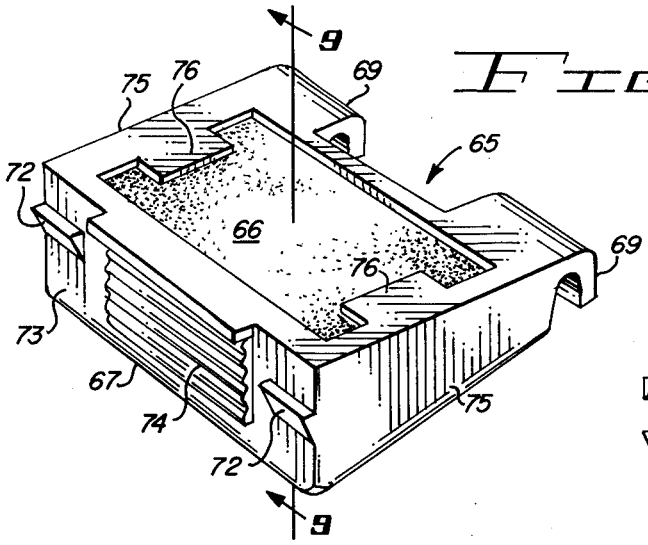
FIG. 8 is a perspective view of the improved inking pad and holder of the invention.
Figure 9:
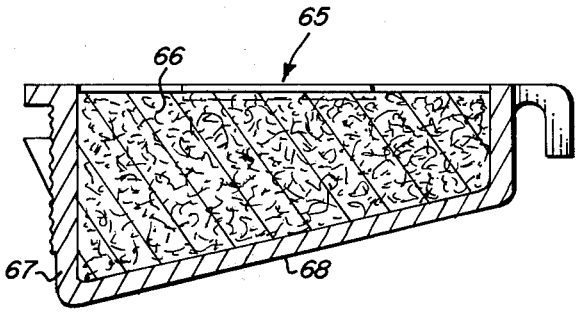
FIG. 9 is a cross-sectional view of the inking pad and holder of FIG. 8 as viewed along line 9—9 of FIG. 8.
Figure 10:
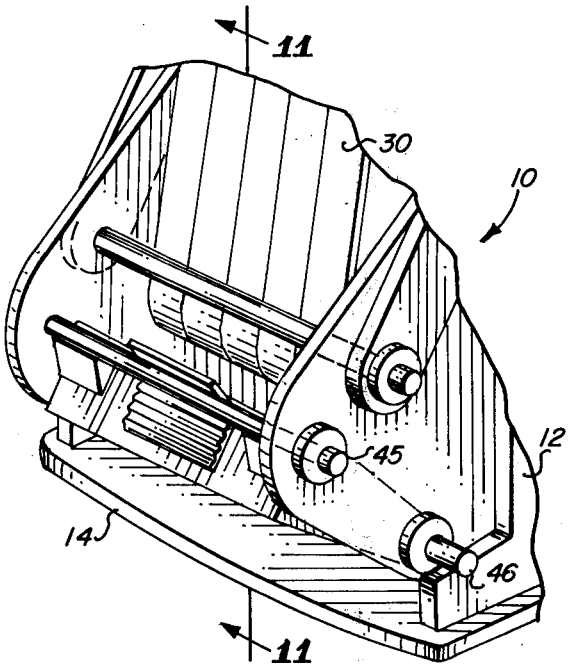
FIG. 10 is a perspective view of a portion of the device of FIGS. 1–5 with the improved inking pad and holder of FIGS. 8 and 9 installed.
Figure 11:
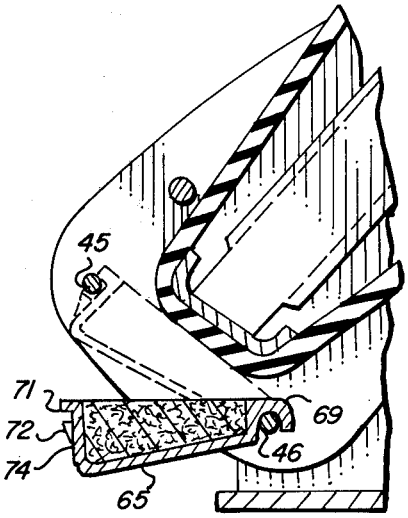
FIG. 11 is a cross-sectional side view of the assembly of FIG. 10 as viewed along line 11—11 of FIG. 10.

In another variation of the invention, the novel inking pad assembly 65 is disclosed in FIGS. 8 and 9, and in FIGS. 10 and 11, it is shown incorporated in the device 10 of FIGS. 1–5 in place of the pad 47 and the tray 48.

The generally wedge shaped pad 66 is of the same material as pad 47, but because of its greater volume it holds a larger quantity of ink and thus requires less frequent loading.

Pad 66 is held by a molded plastic tray which is rectangular but with an inclined bottom panel 68. Positioned at opposite ends of the rear edge are two hinge flanges 69 opening downward which are contoured to snap over rod 46, as shown in FIGS. 10 and 11. At the front edge of tray 67 a centered rectangular projection 71 extends perpendicularly from the top edge while two wedge shaped projections 72 located at opposite ends of the front edge have their upper surfaces also extending perpendicularly from the front wall 73. The vertical separation between the lower surface of projection 71 and the upper surfaces of projections 72 is such as to accommodate snugly therebetween the diameter of rod 45. A rectangular corrugated area 74 is provided just below projection 71 for gripping during installation of assembly 65 in the device 10 of FIGS. 1–5. Extending inwardly from the top edges of end walls 75 are rectangular projections 76 which serve to hold the pad 66 in place.

In FIGS. 11, the assembly 65 is shown being installed in the device 10. The solid line representation of assembly 65 is shown with hinge flanges 69 installed over roller 46. From this position, assembly 65 is pivoted clockwise about roller 46 until projection 71 comes into contact with roller 45 at which time perpendicular pressure is applied to the area 74 to force projection 71 rearward until it clears rod 45. Pressure is then released and rod 45 is captured between projection 71 and projections 72. The assembly 65 is now in position in device 10 to function in place of pad 47 and tray 48 of FIGS. 1–5.

In contrast to the non-removable character of tray 48, however, the assembly 65 may readily be removed for storage or replacement in accordance with the slated objects of the invention.

The wedge shaped cross-section of the tray 67 permits it to be employed in the prior art hand stamp of U.S. Pat. No. 3,783,786 as well as in the device 10 herein disclosed, the shallow rear portion being capable of clearance below the printing unit while the deeper front portion provides volume for ink capacity.

Tray 67 is inexpensively molded in one piece from a flexible plastic material and is thus very inexpensive so that a number of tray and pad assemblies 65 may be economically provided for use with a single device 10. Each may be loaded with different ink colors or different ink formulations for use in stamping various surfaces.

During periods of disuse, the assemblies 65 may be stored in an air-tight container to prevent the ink from drying. The installation of the selected assembly may then be accomplished quickly and easily prior to the next use.

Although but a few embodiments of the present invention have been illustrated and described, it will be apparent to those skilled in the art that various changes and modifications may be made therein without departing from the spirit of the invention or from the scope of the appended claims.

What is claimed is:

1. A hand stamp assembly comprising an upright body frame having matched elongated slots including a base to be thrustingly engaged with an object to be imprinted, a printing frame, a printing unit within the body frame and operatively coupled with said printing frame by means of connecting means from the printing unit to the printing frame riding in said slots, said printing unit having character-carrying means movable to shift different printing characters thereon into printing position facing toward said base, and means normally biasing the printing frame and thereby the printing unit into a retracted position on the body frame away from said base and from which position the printing frame can be moved in opposition to the biasing means to drive the printing characters into imprinting engagement with an object against which the base is thrustingly engaged, including:

said printing frame having a pair of spaced side bars, said bars each having a matching control cam slot therein, each cam slot having a matching shoulder lateral to the longitudinal axis of each cam slot, the shoulders stopping the travel of the printing unit away from the object, each of the shoulders comprising a portion of the periphery of each cam slot, said connecting means being operatively engaged in said cam slots and said elongated slots to effect swinging of the printing unit between a position wherein an inking pad is in inking contact with the printing characters at a position laterally of the longitudinal axis of said body frame to a clearance position in said printing frame to permit movement of the printing frame and the printing unit in opposition to said biasing means and relative to said body frame to effect imprinting by the inked printing characters upon an object against which the base is thrust, and means mounted on said base at the end which engages the object to be imprinted for causing the imprinting to occur at an acute angle to the longitudinal axis of the hand stamp assembly, said means comprising pads mounted on said base wherein the thickness of the pads on one side of said base are greater than the thickness of the pads on the other side of the base.

2. The hand stamp assembly set forth in claim 1 in further combination with:

an ink pad supporting tray hingedly mounted on and between said bars, means normally latching said tray in position on said bars to support the ink pad for its inking function and the latching means being releasable for swinging the tray away from the inking position for access to the inking pad to supply ink thereto, said ink pad comprising a cellular resilient foam material.

3. The hand stamp assembly set forth in claim 2 wherein:

said pad comprises foam latex.

4. The hand stamp assembly set forth in claim 2 wherein:

said pad comprises a polyvinylchloride foam.

* * * * *